US012098052B2

(12) United States Patent
Egawa et al.

(10) Patent No.: US 12,098,052 B2
(45) Date of Patent: Sep. 24, 2024

(54) POSTPROCESSING DEVICE THAT MATCHES MOVING SPEED OF TIP PORTION OF FOLDING BLADE WITH MOVING SPEED OF CIRCUMFERENTIAL SURFACE OF PAIR OF FOLDING ROLLERS, AT PREDETERMINED TIMING

(71) Applicant: KYOCERA Document Solutions Inc., Osaka (JP)

(72) Inventors: Keisuke Egawa, Osaka (JP); Terumitsu Noso, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/111,547

(22) Filed: Feb. 18, 2023

(65) Prior Publication Data

US 2023/0264921 A1 Aug. 24, 2023

(30) Foreign Application Priority Data

Feb. 21, 2022 (JP) ..... 2022-025000

(51) Int. Cl.
*B65H 45/18* (2006.01)
*B65H 5/02* (2006.01)
(Continued)

(52) U.S. Cl.
CPC ..... *B65H 45/147* (2013.01); *B65H 5/025* (2013.01); *B65H 7/20* (2013.01); *B65H 45/164* (2013.01);
(Continued)

(58) Field of Classification Search
CPC ..... B65H 45/04; B65H 45/16; B65H 45/18; B65H 45/148; B65H 45/164; B65H 5/025;
(Continued)

(56) References Cited

U.S. PATENT DOCUMENTS 7,087,007 B2 * 8/2006 Iwama ..... B65H 45/18 493/442
7,871,065 B2 * 1/2011 Fukasawa ..... G03G 15/6582 270/32
(Continued)

FOREIGN PATENT DOCUMENTS

JP 2010168175 A 8/2010
JP 2013082512 A 5/2013

*Primary Examiner* — Leslie A Nicholson, III
(74) *Attorney, Agent, or Firm* — IP Business Solutions, LLC

(57) ABSTRACT

A postprocessing device performs postprocessing on sheets received from an image forming apparatus. The postprocessing device includes a pair of folding rollers, a folding blade, a transport device, a drive portion, and a drive controller. The drive controller controls the drive portion to match moving speed of a tip portion of the folding blade with moving speed of a circumferential surface of the folding rollers, at a time point that the sheaf of the sheets makes contact with the circumferential surface of the folding rollers, when the image forming apparatus forms the image by ink jet printing, and to match the moving speed of the tip portion of the folding blade with the moving speed of the circumferential surface of the folding rollers, at a time point that the sheaf of the sheets reaches the nip region between the folding rollers.

3 Claims, 10 Drawing Sheets

(51) Int. Cl.
*B65H 7/20* (2006.01)
*B65H 45/14* (2006.01)
*B65H 45/16* (2006.01)

(52) U.S. Cl.
CPC .... *B65H 2511/224* (2013.01); *B65H 2801/27* (2013.01)

(58) Field of Classification Search
CPC ..... B65H 7/20; B65H 2511/224; B65H 2801/27; G03G 2215/00877; B41L 43/06; B41L 43/12
USPC ..... 270/32; 493/442, 443, 444, 445
See application file for complete search history.

(56) References Cited

U.S. PATENT DOCUMENTS

| | | | | |
|---|---|---|---|---|
| 8,590,880 | B2 * | 11/2013 | Imazu | G03G 15/6582 399/407 |
| 9,823,611 | B2 * | 11/2017 | Osada | B65H 43/00 |
| 11,685,627 | B2 * | 6/2023 | Mio | B65H 31/20 270/1.01 |
| 2012/0046154 | A1 * | 2/2012 | Takeuchi | B65H 45/18 493/405 |
| 2013/0087965 | A1 | 4/2013 | Shimizu | |

* cited by examiner

POSTPROCESSING DEVICE THAT MATCHES MOVING SPEED OF TIP PORTION OF FOLDING BLADE WITH MOVING SPEED OF CIRCUMFERENTIAL SURFACE OF PAIR OF FOLDING ROLLERS, AT PREDETERMINED TIMING

INCORPORATION BY REFERENCE

This application claims priority to Japanese Patent Application No. 2022-025000 filed on Feb. 21, 2022, the entire contents of which are incorporated by reference herein.

BACKGROUND

The present disclosure relates to a postprocessing device that performs postprocessing on a sheaf of sheets, formed by stacking a plurality of recording sheets on each other, and in particular to a technique to fold the sheaf of the sheets.

In an image forming apparatus, an image reading device reads the image of a source document, and an image forming device forms the image of the source document on a sheet (recording sheet). The postprocessing device receives the sheet having the image of the source document formed thereon from the image forming apparatus, and performs postprocessing on the sheet. The postprocessing includes, for example, a folding operation for folding a sheaf of a plurality of sheets stacked on each other.

For example, a folding device is known that includes a pair of folding rollers, and a folding blade movable toward and away from the nip region between the pair of folding rollers. In this folding device, when the sheet is delivered from the image forming apparatus through a delivery roller, and transported to the pair of folding rollers, the folding blade is moved with the sheet to the nip region between the pair of folding rollers, so that the pair of folding rollers catch and fold the sheet. The folding device rotates the pair of folding rollers at the same linear speed as the delivering linear speed of the delivery roller, when folding the sheet. In addition, the folding blade is set to move slower than the linear speed of the pair of folding rollers. With such setting, the folding operation can be executed without the need to slow down or temporarily stop the rotation of the pair of folding rollers, which leads to improved productivity.

In addition, a sheet postprocessing device is known that starts to move a squeezing plate, corresponding to the folding blade, when a predetermined time has elapsed after the leading edge of the recording sheet, transported by a transport roller pair, was detected by a sheet edge sensor. In this sheet postprocessing device, the squeezing plate is set to move faster than the transport speed of the recording sheet. Further, the postprocessing device is configured to squeeze the recording sheet with the squeezing plate, so as to pull back a portion of the recording sheet downstream of the contact position of the squeezing plate in the sheet transport direction, in the direction opposite to the sheet transport direction. Such an arrangement enables the recording sheet being transported to be folded at the desired folding position, without the need to provide a stopper for the recording sheet.

SUMMARY

The disclosure proposes further improvement of the foregoing techniques.

In an aspect, the disclosure provides a postprocessing device that receives sheets from an image forming apparatus that forms an image on the sheets, and performs postprocessing on the sheets. The postprocessing device includes a pair of folding rollers, a folding blade, a transport device, a drive portion, and a drive controller. The pair of folding rollers form a nip region by being pressed against each other, and catch and fold a sheaf of the sheets, by rotating in opposite directions to each other. The folding blade is supported so as to move toward and away from the nip region at predetermined moving speed, and squeezes the sheaf of the sheets into the nip region. The transport device transports the sheets to a position between the nip region and the folding blade. The drive portion moves the folding blade toward and away from the nip region. The drive controller configured to control an operation of the drive portion. The drive controller controls the operation of the drive portion so as to match the moving speed of a tip portion of the folding blade with moving speed of a circumferential surface of the pair of folding rollers, at a time point that the sheaf of the sheets makes contact with the circumferential surface of the pair of folding rollers, when the image forming apparatus forms the image by ink jet printing, and controls the operation of the drive portion so as to match the moving speed of the tip portion of the folding blade with the moving speed of the circumferential surface of the pair of folding rollers, at a time point that the sheaf of the sheets reaches the nip region after the sheaf of the sheets makes contact with the circumferential surface of the pair of folding rollers, when the image forming apparatus forms the image by electrophotography.

In another aspect, the disclosure provides a postprocessing device including a pair of folding rollers, a folding blade, a transport device, a drive portion, and a drive controller. The pair of folding rollers form a nip region by being pressed against each other, and pinch and fold a sheaf of the sheets, by rotating in opposite directions to each other. The folding blade is supported so as to move toward and away from the nip region at predetermined moving speed, and squeezes the sheaf of the sheets into the nip region. The transport device transports the sheets to a position between the nip region and the folding blade. The drive portion moves the folding blade toward and away from the nip region. The drive controller configured to control an operation of the drive portion. The drive controller controls the operation of the drive portion so as to match the moving speed of a tip portion of the folding blade with moving speed of a circumferential surface of the pair of folding rollers, at a time point that the sheaf of the sheets makes contact with the circumferential surface of the pair of folding rollers.

In still another aspect, the disclosure provides a postprocessing device including a pair of folding rollers, a folding blade, a transport device, a drive portion, and a drive controller. The pair of folding rollers form a nip region by being pressed against each other, and pinch and fold a sheaf of the sheets, by rotating in opposite directions to each other. The folding blade is supported so as to move toward and away from the nip region at predetermined moving speed, and squeezes the sheaf of the sheets into the nip region. The transport device transports the sheets to a position between the nip region and the folding blade. The drive portion moves the folding blade toward and away from the nip region. The drive controller configured to control an operation of the drive portion. The drive controller controls the operation of the drive portion so as to match the moving speed of a tip portion of the folding blade with moving speed of a circumferential surface of the pair of folding rollers, at a time point that the sheaf of the sheets reaches the nip region.

DETAILED DESCRIPTION

Hereafter, a postprocessing device and a postprocessing system according to some embodiments of the disclosure will be described, with reference to the drawings.

First Embodiment

Figure 1:
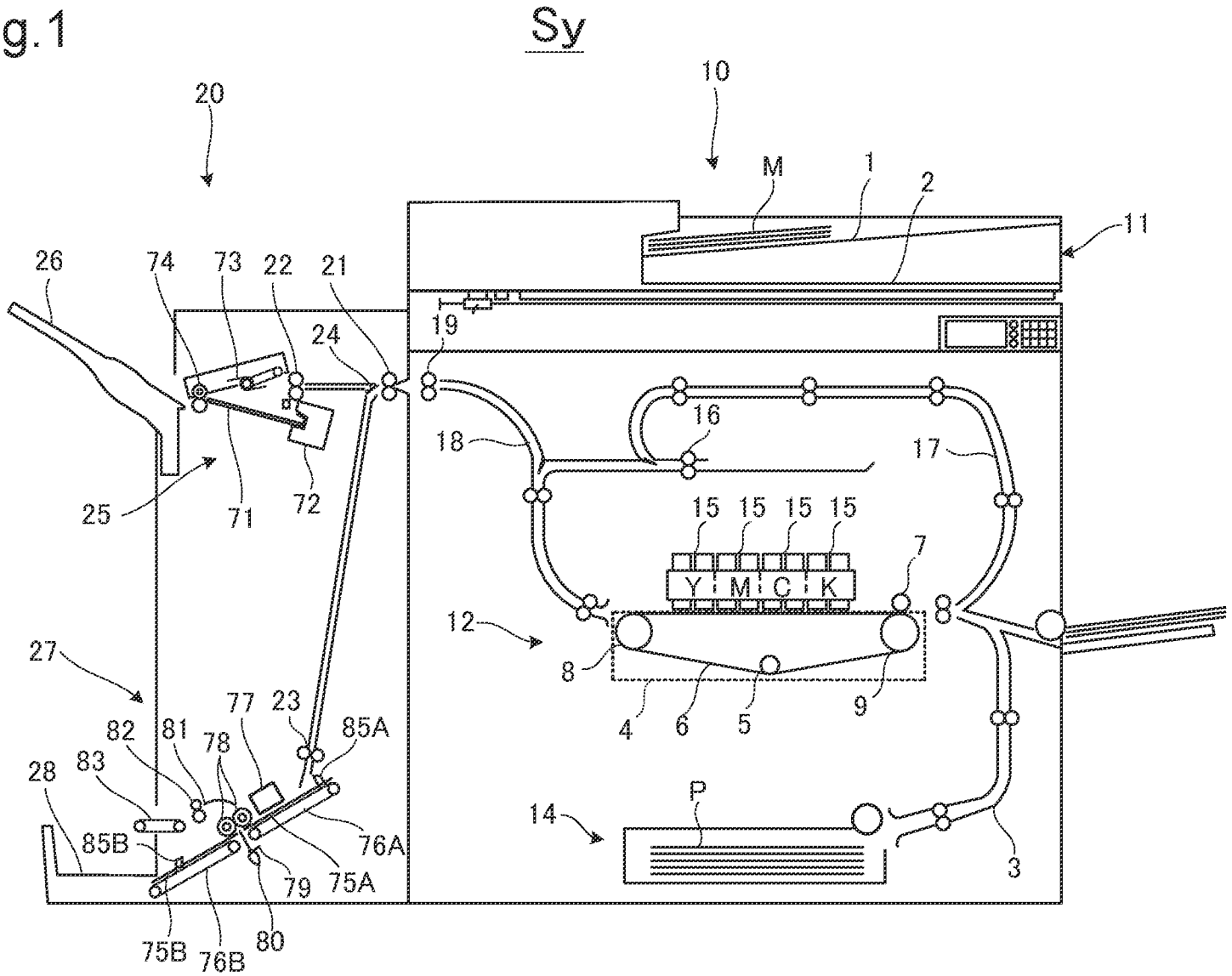
FIG. 1 is a cross-sectional view of an image forming apparatus and a postprocessing device, included in a postprocessing system according to a first embodiment.

FIG. 1 is a cross-sectional view of an image forming apparatus 10 and a postprocessing device 20, included in a postprocessing system Sy according to a first embodiment of the disclosure. As shown in FIG. 1, the postprocessing system Sy includes the image forming apparatus 10 that reads an image of a source document and forms the image on a recording sheet, and the postprocessing device 20 that receives the recording sheet from the image forming apparatus 10, and performs postprocessing on the recording sheet.

The image forming apparatus 10 includes an image reading device 11 and an image forming device 12. When a plurality of source documents M are placed on a document tray 1, the image reading device 11 sequentially draws out those source documents M from the document tray 1 one by one, reads the image of each of the source documents M with an image sensor, and sequentially delivers the source documents M to the discharge tray 2, so as to stack on each other. The image reading device 11 converts the analog output from the image sensor to a digital signal with respect to the image of each of the source documents M, and generates image data representing the image of each of the source documents M.

The image forming device 12 forms the image of the source document M represented by the image data, on the recording sheet P through an ink jet process, each time each of a plurality of pieces of image data, representing the respective images of a plurality of source documents M, is sequentially inputted. The image forming device 12 includes line heads 15 (exemplifying the ink head in the disclosure) that respectively eject ink of four colors, namely black, cyan, magenta, and yellow. The line heads 15 each eject the ink droplets of the corresponding color onto the recording sheet P, delivered to a conveying unit 4 from a paper feeding device 14 through a first transport route 3, thereby forming a color image on the recording sheet P.

The conveying unit 4 includes a drive roller 8, a follower roller 9, tension roller 5, and a transport belt 6. The transport belt 6 is an endless belt stretched around the drive roller 8, the follower roller 9, and the tension roller 5. The drive roller 8 is driven by a motor so as to rotate counterclockwise. When the drive roller 8 is made to rotate, the transport belt 6 revolves counterclockwise, and the follower roller 9 and the tension roller 5 are each passively made to rotate counterclockwise.

The tension roller 5 serves to maintain the tension of the transport belt 6 at an appropriate level. An adsorption roller 7, located in contact with the transport belt 6, electrically charges the transport belt 6, to thereby electrostatically adsorb the recording sheet P delivered from the paper feeding device 14, to the transport belt 6.

After causing the image forming device 12 to form the image of the source document M on the recording sheets P, a controller 46 of the image forming apparatus 10 (see FIG. 2), to be subsequently described, transports the recording sheet P to the postprocessing device 20, through a relay transport route 18 and a delivery roller 19.

When the image of the source document M is also to be formed on the back face of the recording sheet P, the controller 46 performs switchback transport, including transporting the recording sheet P from the relay transport route 18 to the transport roller 16, once stopping the transport roller 16 and then reversely rotating the same, to return the recording sheet P to the conveying unit 4 through the second transport route 17, in the inverted orientation. Then the controller 46 causes the image forming device 12 to form the image of the source document M on the back face of the recording sheet P, and transports the recording sheet P to the postprocessing device 20, through the relay transport route 18 and the delivery roller 19.

The postprocessing device 20 includes a plurality of transport roller pairs 21, 22, and 23, a branching nail 24, a one-side binder 25, an output tray 26, a saddle-stitch binder 27, and an output tray 28. The transport roller pairs 21, 22, and 23 each serve to transport the recording sheet P delivered from the image forming apparatus 10. The branching nail 24 guides the recording sheet P that has passed through the transport roller pair 21 in the horizontal direction toward the transport roller pair 22, or to the lower side toward the transport roller pair 23.

The one-side binder 25 performs stapling operation on one end portion of a sheaf of the recording sheets, composed of a plurality of recording sheets P stacked on each other. To the output tray 26, the sheaf of the recording sheets stapled by the one-side binder 25 is delivered. The saddle-stitch binder 27 performs the stapling operation on the central position of the sheaf of the recording sheets, composed of a plurality of recording sheets P stacked on each other, and folds the sheaf of the recording sheets at the center. To the output tray 28, the sheaf of the recording sheets stapled and folded by the saddle-stitch binder 27 is delivered.

The one-side binder 25 includes a processing tray 71, a stapling device 72, a paddle 73, and a delivery roller 74. To the processing tray 71, a plurality of recording sheets P, transported by the transport roller pairs 21 and 22, are each sequentially delivered. The stapling device 72 performs the stapling operation, on one end portion of the sheaf of the recording sheets, composed of a plurality of recording sheets P stacked on each other, on the processing tray 71. The paddle 73 urges the recording sheet P to move to the stapling device 72, each time the recording sheet P is delivered to the processing tray 71. The delivery roller 74 delivers the sheaf of the recording sheets stapled by the stapling device 72, to the output tray 26.

The saddle-stitch binder 27 includes a pair of divided trays 75A and 75B, a pair of stoppers 85A and 85B, revolving belts 76A and 76B, a stapling device 77, a pair of folding rollers 78, a folding blade 79, a rotary cam 80, a guide 81, a transport roller pair 82, and a delivery conveyor 83. To the divided trays 75A and 75B, a plurality of recording sheets P, transported by the transport roller pairs 21 and 23 (exemplifying the transport device in the disclosure), are each sequentially delivered. The stoppers 85A and 85B each serve to move the recording sheet P or the sheaf of the recording sheets composed of a plurality of recording sheets P on the divided trays 75A and 75B, to adjust the position of the recording sheet P or the sheaf of the recording sheets. The revolving belts 76A and 76B respectively support the stoppers 85A and 85B, and move the stoppers 85A and 85B in the transport direction of the recording sheet P.

The stapling device 77 performs the stapling operation on the central portion of the sheaf of the recording sheets on the divided trays 75A and 75B. The pair of folding rollers 78 are located on the upper side of the space between the divided trays 75A and 75B, and pressed against each other. The folding blade 79 is opposed to the nip region between the pair of folding rollers 78, across the space between the divided trays 75A and 75B. The rotary cam 80 serves to move the folding blade 79 toward and away from the nip region between the pair of folding rollers 78. The guide 81 is located on the downstream side in the transport direction of the sheaf of the recording sheets transported by the pair of folding rollers 78, to guide the sheaf of the recording sheets. The transport roller pair 82 transports the sheaf of the recording sheets. The delivery conveyor 83 delivers the sheaf of the recording sheets to the output tray 28.

Figure 2:
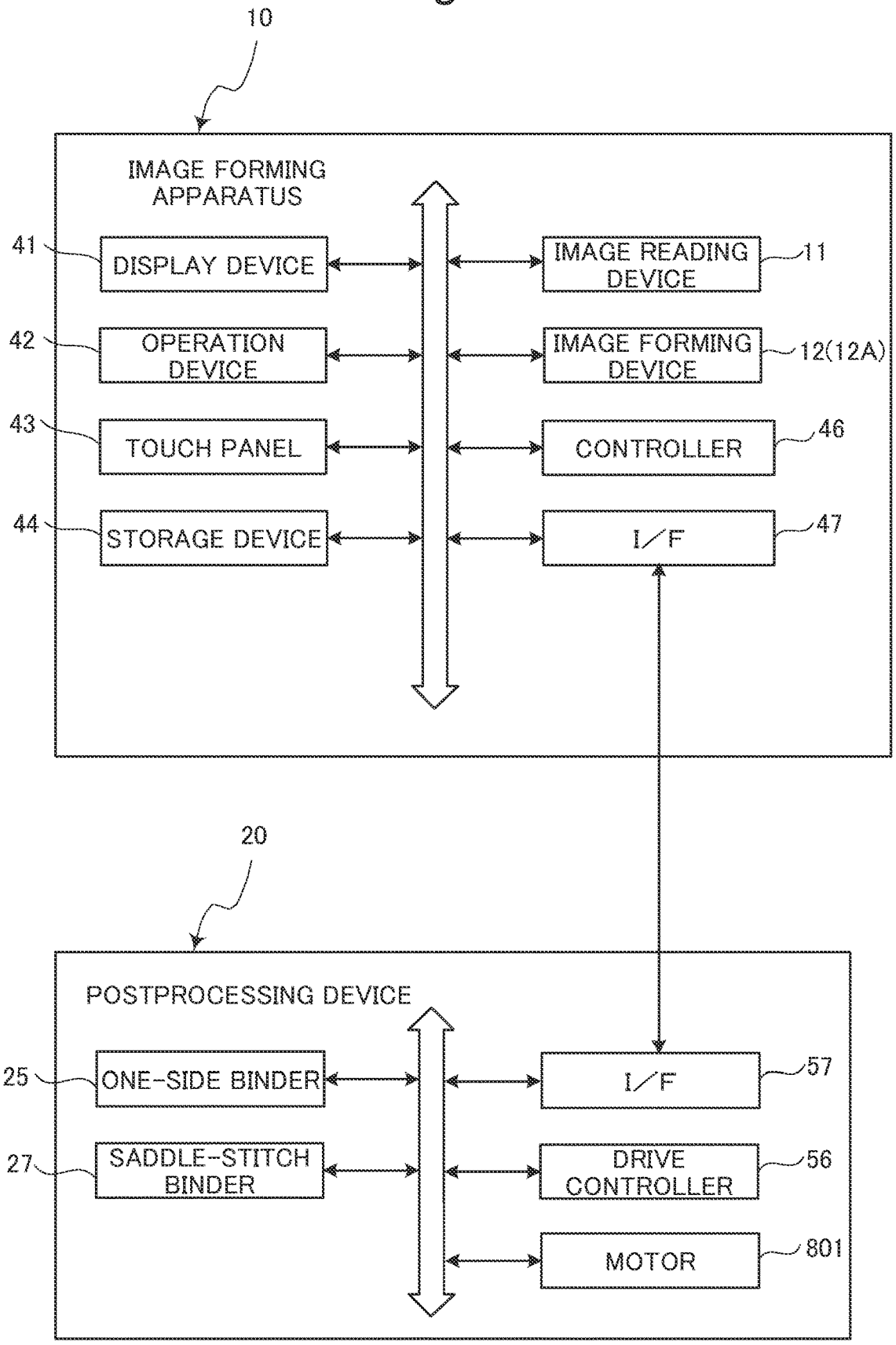
FIG. 2 is a functional block diagram schematically showing an essential internal configuration of the image forming apparatus and the postprocessing device image.

Hereunder, a configuration related to the control operation of the image forming apparatus 10 and the postprocessing device 20 will be described. FIG. 2 is a functional block diagram showing an essential internal configuration of the image forming apparatus 10 and the postprocessing device 20. As shown in FIG. 2, the image forming apparatus 10 includes the image reading device 11, the image forming device 12, a display device 41, an operation device 42, a touch panel 43, a storage device 44, the controller 46, and an interface (I/F) 47. The mentioned components are configured to transmit and receive data and signals to and from each other, via a bus.

The display device 41 is, for example, constituted of a liquid crystal display (LCD) or an organic light-emitting diode (OLED) display. The operation device 42 includes physical keys such as a tenkey, an enter key, and a start key.

A touch panel 43 is overlaid on the screen of the display device 41. The touch panel 43 is, for example, based on a resistive film or electrostatic capacitance. The touch panel 43 detects a contact (touch) of the user's finger, along with the touched position, and outputs a detection signal indicating the coordinate of the touched position, to the control device 46.

The storage device 44 is a large-capacity storage device such as a solid-state drive (SSD) or a hard disk drive (HDD). The storage device 44 contains various application programs and various types of data.

The controller 46 is connected to the image reading device 11, the image forming device 12, the display device 41, the operation device 42, the touch panel 43, the storage device 44, and the I/F 47. The controller 46 controls the operation of the components cited above, and transmits and receives signals and data to and from those components. In other words, the controller 46 executes the controls and processings necessary for the operation of the image forming apparatus 10.

The controller 46 includes a processor, a random-access memory (RAM), a read-only memory (ROM), and so forth. The processor is, for example, a central processing unit (CPU), an application specific integrated circuit (ASIC), or a micro processing unit (MPU). The controller 46 executes various controls and processings necessary for the operation by the image forming apparatus 10, according to the control program stored in the ROM or the storage device 44.

The controller 46 controls the displaying operation of the display device 41. The controller 46 receives the instruction inputted by the user, on the basis of the detection signal outputted from the touch panel 63 or a press of the physical key on the operation device 62. For example, the controller 66 receives the instruction according to a touch operation, performed through the touch panel 63 on the graphical user interface (GUI) displayed on the screen of the display device 61.

The postprocessing device 20 includes the one-side binder 25, the saddle-stitch binder 27, a drive controller 56, an I/F 57, and a motor 801. These components are configured to transmit and receive data and signals to and from each other, via a bus. The drive controller 56 includes a processor, a RAM, a ROM, and so forth. The drive controller 56 controls the operation of the one-side binder 25 and the saddle-stitch binder 27.

The controller 46 of the image forming apparatus 10 and the drive controller 56 of the postprocessing device 20 are configured to input and output data and signals between each other, via the respective I/Fs 47 and 57. For example, the controller 46 of the image forming apparatus 10 outputs a control signal for instructing the postprocessing device 20 to perform the postprocessing, to the drive controller 56 of the postprocessing device 20. The drive controller 56 of the postprocessing device 20 controls the operation of the one-side binder 25 or the saddle-stitch binder 27, according to the control signal received.

When the saddle-stitch binding operation is to be executed in the postprocessing system Sy, the user inputs the instruction to execute the saddle-stitch binding operation, by operating, through the touch panel 43, the GUI displayed on the screen of the display device 41. Then the user sets a plurality of source documents M on the image reading device 11, and presses the start key of the operation device 42, thus inputting a copying instruction.

Upon receipt of the instruction to execute the saddle-stitch binding operation and the copying instruction, the controller 46 of the image forming apparatus 10 outputs a control signal indicating the instruction to execute the saddle-stitch binding operation to the postprocessing device 20 through the I/F 47 and, at the same time, causes the image reading device 11 to sequentially read the image of each of the source documents M. Then the controller 46 causes the image forming device 12 to form the image of each of the source documents M on one recording sheet P, and sequentially transport the recording sheets P to the postprocessing device 20.

When the recording sheets P delivered from the image forming apparatus 10 are sequentially received, the drive controller 56 of the postprocessing device 20 controls the operation of the motors that respectively serve as the drive source for the revolving belts 76A and 76B of the saddle-stitch binder 27, the pair of folding rollers 78, the rotary cam 80, the transport roller pair 82, and the delivery conveyor 83, thereby causing the mentioned components to operate, on the basis of the control signal indicating the instruction to execute the saddle-stitch binding operation, inputted through the I/F 57. As result, the stapling operation is performed on the central portion of the sheaf of the recording sheets composed of a plurality of recording sheets P, and the sheaf of the recording sheets is folded at the center and delivered to the output tray 28.

Figure 3:
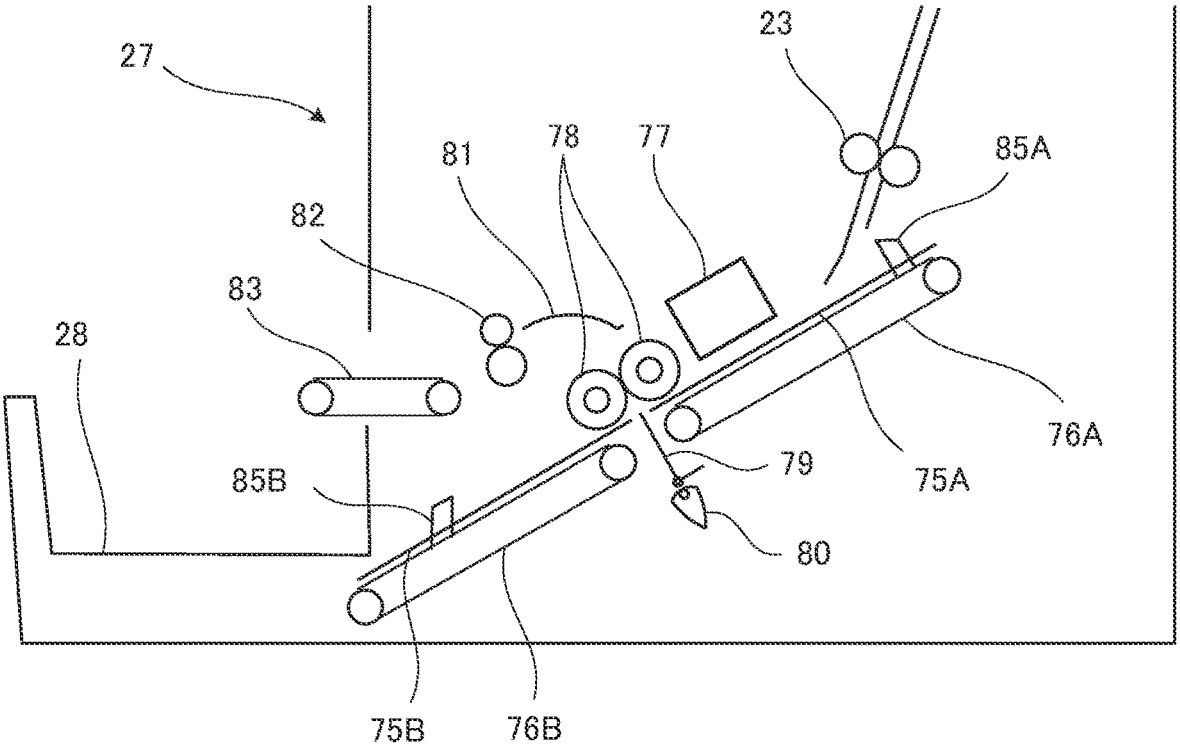
FIG. 3 is an enlarged cross-sectional view of a saddle-stitch binder in the postprocessing device.

FIG. 3 is an enlarged cross-sectional view of the saddle-stitch binder 27. In the saddle-stitch binder 2, as shown in FIG. 3, the two divided trays 75A and 75B are aligned along the transport direction of the recording sheet P delivered through the transport roller pair 23, with a clearance between each other. A plurality of recording sheets P are sequentially delivered through the transport roller pair 23, and stacked on the divided trays 75A and 75B.

Each time the recording sheet P is placed on the divided trays 75A and 75B, the drive controller 56 drives the revolving belts 76A and 76B according to the size of the recording sheet P in the transport direction, so as to abut the respective edges of the recording sheet P against the stoppers 85A and 85B, thus aligning the edges of the recording sheets P. As result, the recording sheets P stacked on the divided trays 75A and 75B constitute the sheaf of the recording sheets. The drive controller 56 moves the sheaf of the recording sheets on the divided trays 75A and 75B using the stoppers 85A and 85B, by driving the revolving belts 76A and 76B, thereby locating the center of the sheaf of the recording sheets at the stapling position of the stapling device 77.

The drive controller 56 causes the stapling device 77 to perform the stapling operation on the center of the sheaf of the recording sheets. The drive controller 56 then moves the sheaf of the recording sheets on the divided trays 75A and 75B using the stoppers 85A and 85B, by driving the revolving belts 76A and 76B, thereby locating the center of the sheaf of the recording sheets at the position corresponding to the space between the divided trays 75A and 75B. The drive controller 56 causes the pair of folding rollers 78 to rotate in opposite directions to each other, as indicated by arrows in FIG. 4, and causes the rotary cam 80 to rotate so as to move the folding blade 79 toward and away from the nip region between the pair of folding rollers 78, as indicated by an arrow D in FIG. 4.

When the folding blade 79 is moved toward the nip region between the pair of folding rollers 78, with the sheaf of the recording sheets interposed therebetween, the central portion of the sheaf of the recording sheets is lifted up by the tip portion of the folding blade 79, and then squeezed into the nip region between the pair of folding rollers 78. As result, the sheaf of the recording sheets is folded along the center, and assumes a double-folded shape. The sheaf of the recording sheets thus folded passes through the pair of folding rollers 78, and guided by the guide 81 to the transport roller pair 82. Then the sheaf of the recording sheets is transported by the transport roller pair 82 to the delivery conveyor 83, and delivered to the output tray 28 through the delivery conveyor 83.

Figure 4:
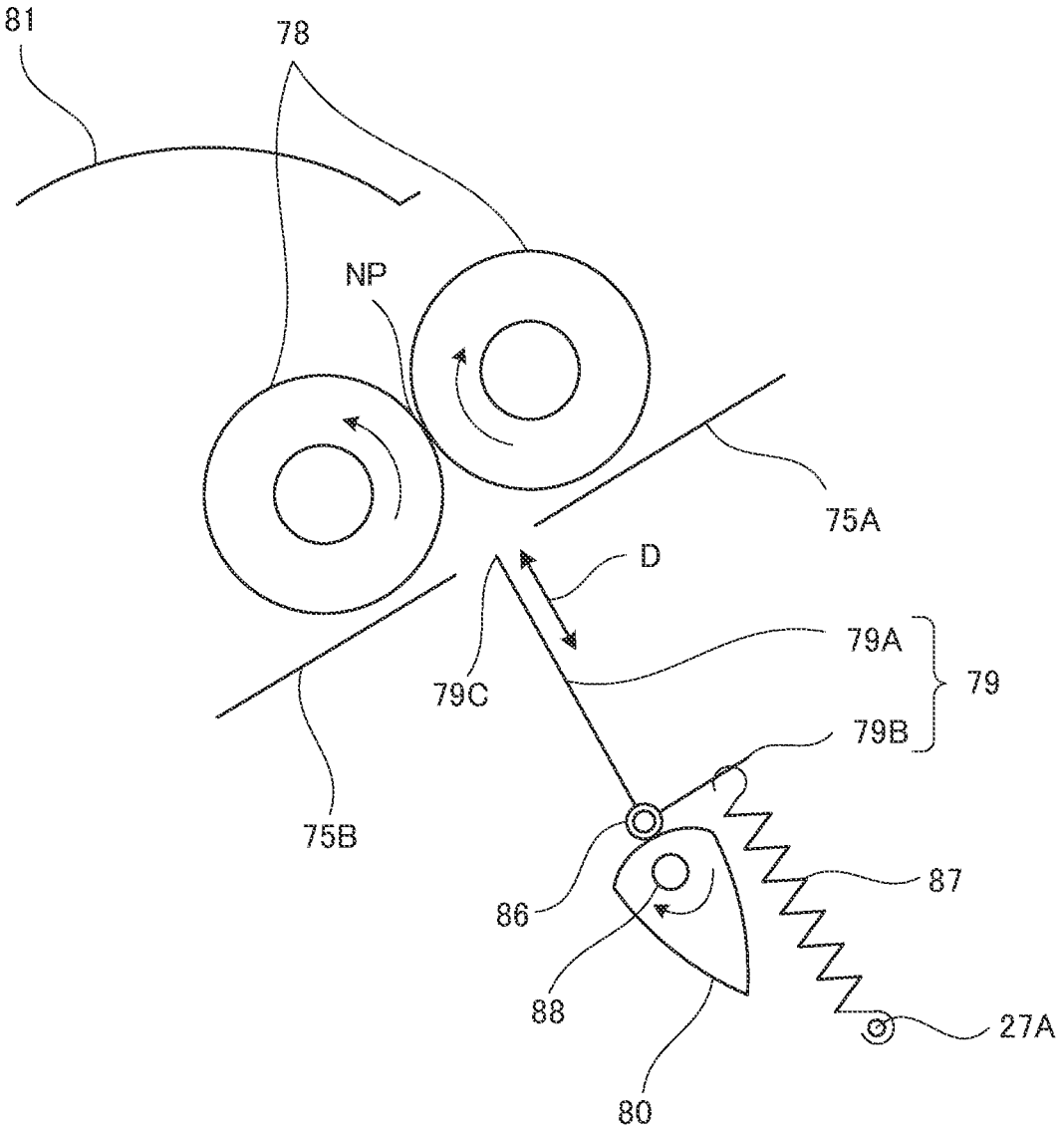
FIG. 4 is an enlarged cross-sectional view of a part of the saddle-stitch binder.

FIG. 4 is an enlarged cross-sectional view of the divided trays 75A and 75B, the pair of folding rollers 78, the folding blade 79, and the rotary cam 80, of the saddle-stitch binder 27. As shown in FIG. 4, the folding blade 79 has an L-shaped cross-section, including a vertical plate 79A and a bottom plate 79B. The folding blade 79 is supported so as to move toward and away from the nip region NP between the pair of folding rollers 78, as indicated by the arrow D. At the lower end portion of the vertical plate 79A of the folding blade 79, a contact roller 86 is rotatably supported.

The rotary cam 80 is supported by a rotary shaft 88. The rotary cam 80 rotates interlocked with the rotary shaft 88. A coil spring 87 is provided, in a stretched state, between the bottom plate 79B of the folding blade 79 and a fixed position 27A in the saddle-stitch binder 27 (e.g., frame of the saddle-stitch binder 27). The coil spring 87 biases the folding blade 79 in the direction away from the nip region NP between the pair of folding rollers 78. The rotary cam 80 is formed in such a shape that the radius between the rotation center and the cam surface is different, depending on the position on the cam surface.

The contact roller 86 of the folding blade 79 moves along the direction of the arrow D, together with the folding blade 79. The rotation center of the rotary shaft 88 and the rotary cam 80 is located on the extension line of the moving track of the contact roller 86 along the direction of the arrow D. Since the folding blade 79 is biased by the coil spring 87 in the direction away from the nip region NP between the pair of folding rollers 78, the contact roller 86 of the folding blade 79 is constantly pressed against the cam surface of the rotary cam 80.

Accordingly, when the rotary cam 80 (i.e., rotary shaft 88) rotates, the contact roller 86 of the folding blade 79 follows up movement of the cam surface of the rotary cam 80, so as to move in the direction of the arrow D, and therefore the tip portion 79C of the folding blade 79 also moves in the direction of the arrow D. The motor 801 shown in FIG. 2 drives the rotary shaft 88 and the rotary cam 80 so as to rotate. Here, the rotary cam 80, the contact roller 86, the coil spring 87, the rotary shaft 88, and the motor 801 exemplify the drive portion in the disclosure, for moving the folding blade 79 in the direction of the arrow D.

Figure 5A:
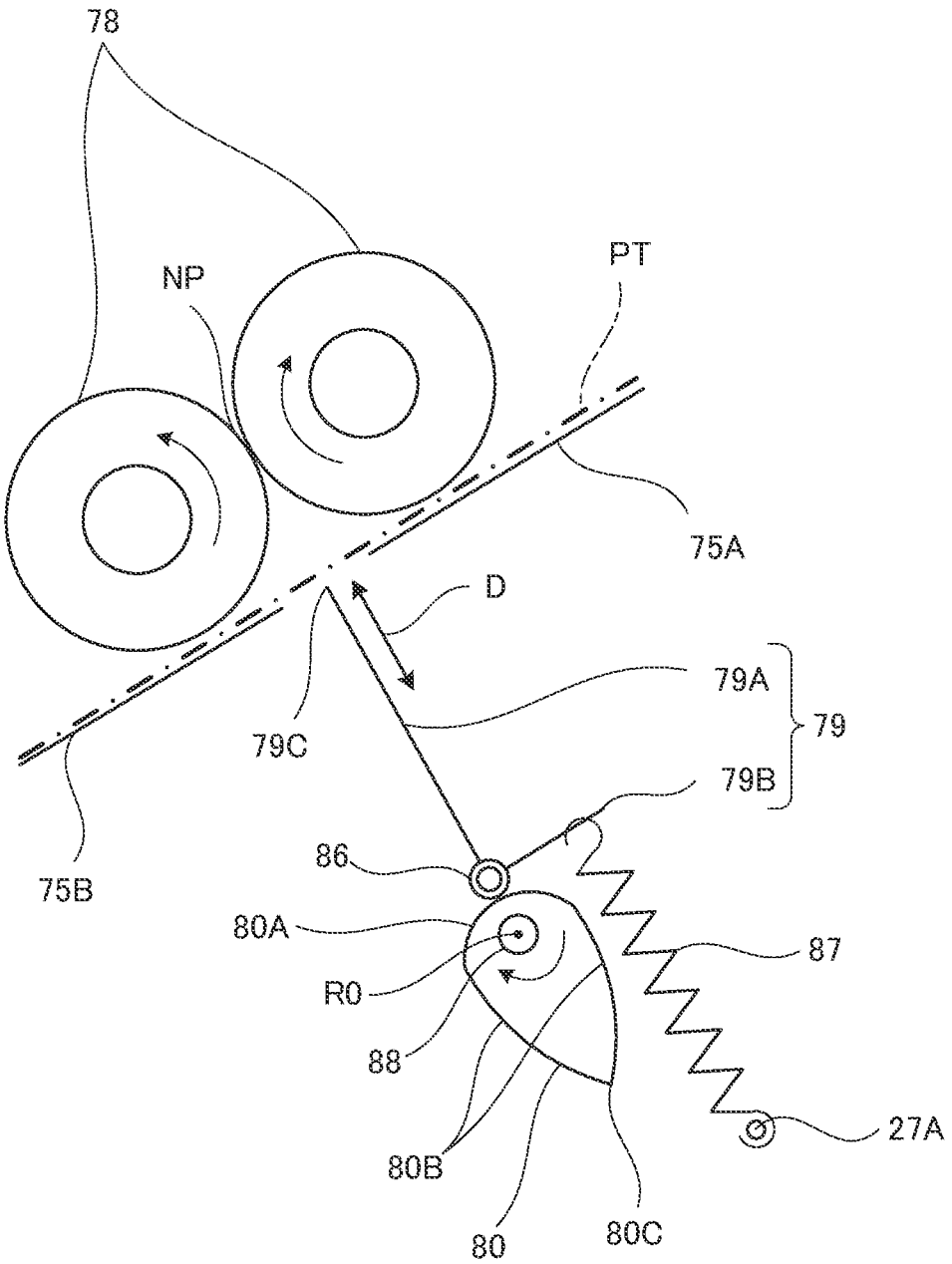
FIG. 5A and FIG. 5B are cross-sectional views each showing how a folding blade moves.

Referring to FIG. 5A, the rotary cam 80 includes a circumferential section 80A closest to the rotation center R0 (rotary shaft 88) of the rotary cam 80, a circumferential section 80C farthest from the rotation center R0, and two circumferential sections 80B located between the circumferential section 80A and the circumferential section 80C. When the contact roller 86 of the folding blade 79 is in contact with the circumferential section 80A of the rotary cam 80, the contact roller 86 is farthest from the nip region NP between the pair of folding rollers 78. In other words, the tip portion 79C of the folding blade 79 is also at the farthest position from the nip region NP, and retracted from the space between the divided trays 75A and 75B. It is in such a state, that the sheaf of the recording sheets PT is moved on the divided trays 75A and 75B, so that the central portion of the sheaf of the recording sheets PT is located at the position corresponding to the space between the divided trays 75A and 75B.

Figure 5B:
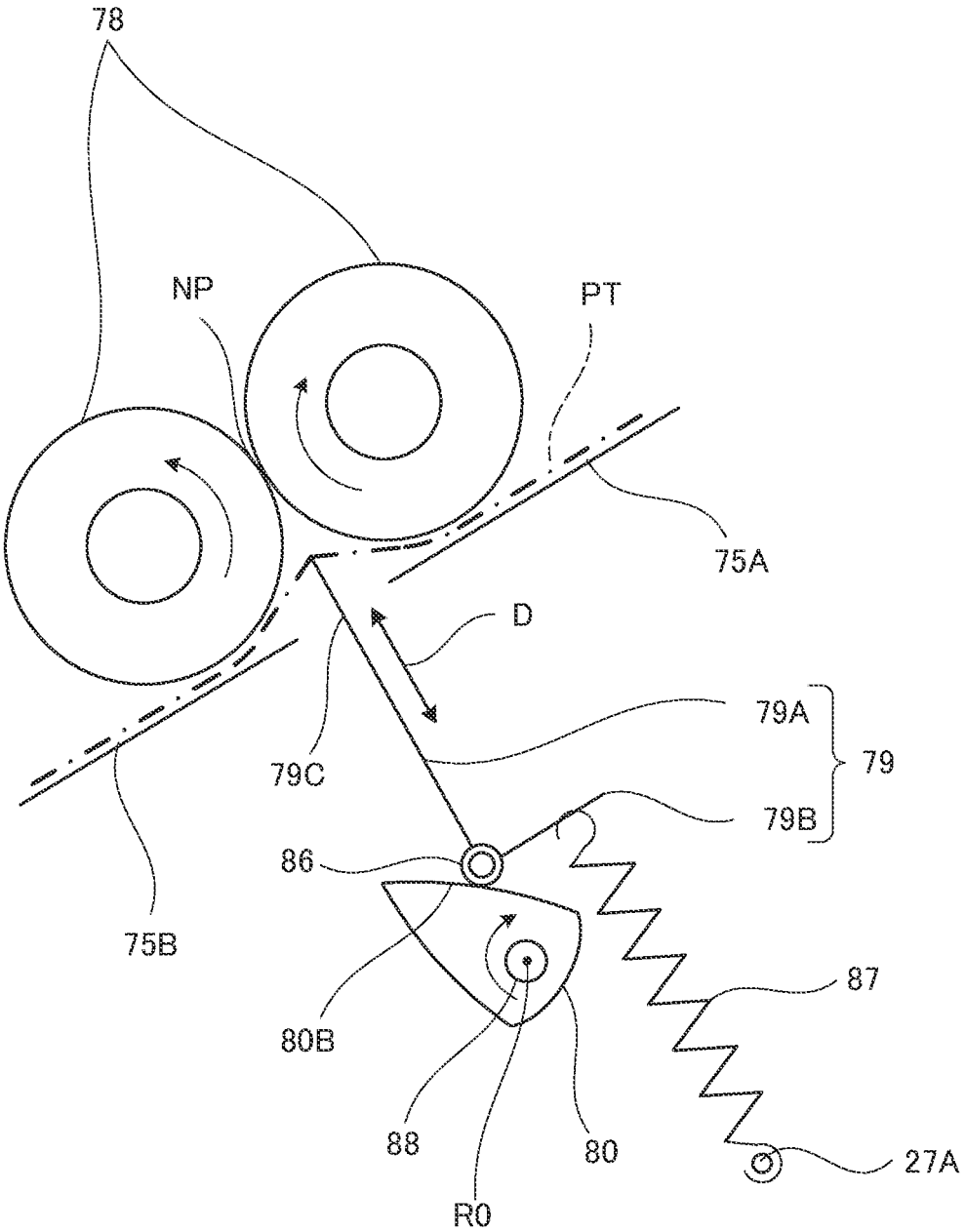

Proceeding to FIG. 5B, when the rotary cam 80 (rotary shaft 88) rotates in the direction indicated by an arrow, the contact roller 86 of the folding blade 79 is lifted up by one of the circumferential sections 80B of the rotary cam 80, so as to move toward the nip region NP, and the tip portion 79C of the folding blade 79 also moves toward the nip region NP, and lifts up the central portion of the sheaf of the recording sheets PT. Thus, the folding operation of the central portion of the sheaf of the recording sheets PT is started.

Figure 6A:
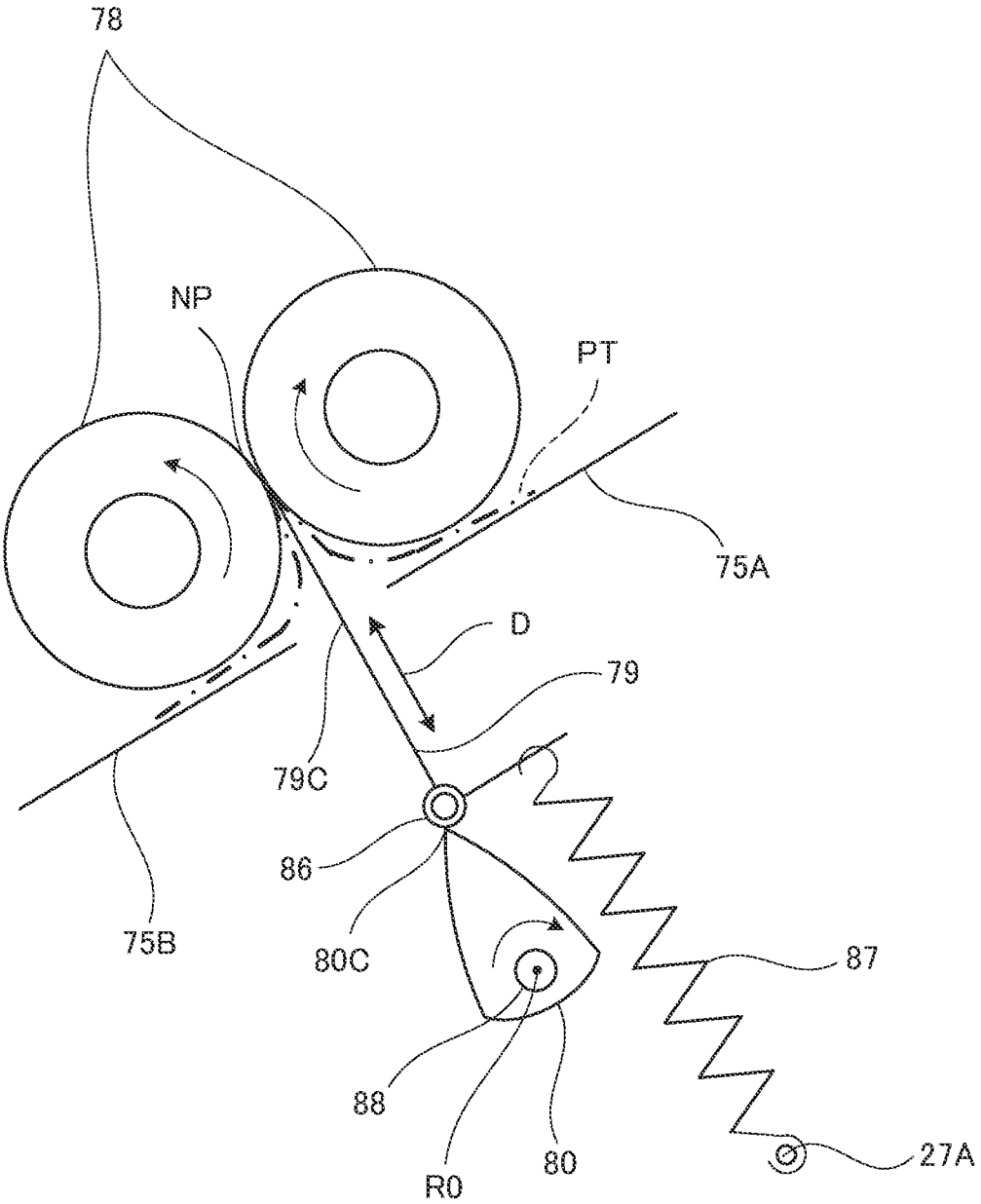
FIG. 6A and FIG. 6B are cross-sectional views each showing how the folding blade moves, after FIG. 5A and FIG. 5B.

Proceeding to FIG. 6A, when the rotary cam 80 (rotary shaft 88) rotates by 180 degrees, and the contact roller 86 of the folding blade 79 enters into contact with the circumferential section 80C, the contact roller 86 of the folding blade 79 reaches the position closest to the nip region NP between the pair of folding rollers 78, and the tip portion 79C of the folding blade 79 also reaches the position closest to the nip region NP. As result, the central portion of the sheaf of the recording sheets PT is squeezed into the nip region NP between the pair of folding rollers 78, thus to be folded.

Figure 6B:
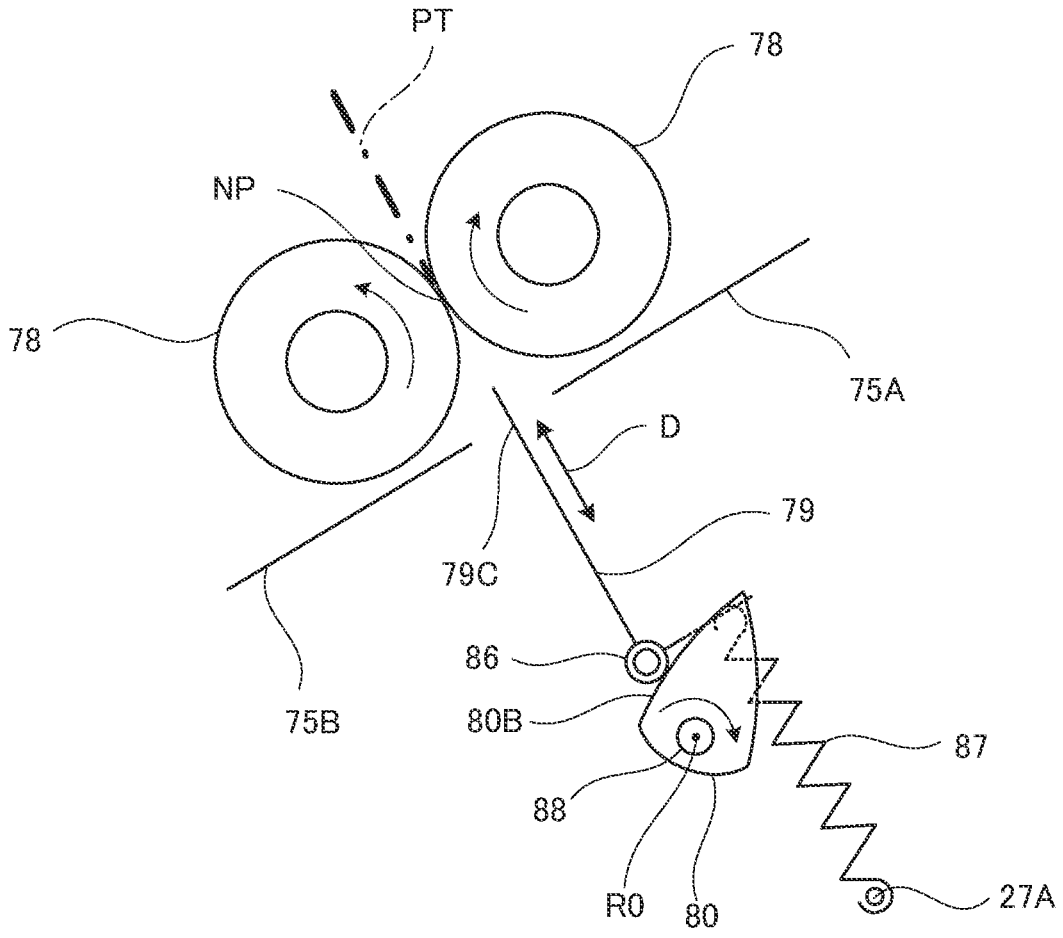

Proceeding to FIG. 6B, when the rotary cam 80 (rotary shaft 88) rotates further, the contact roller 86 of the folding blade 79 moves away from the nip region NP between the pair of folding rollers 78, by keeping contact with the other circumferential section 80B of the rotary cam 80, and the tip portion 79C of the folding blade 79 also moves away from the nip region NP and withdraws from the space between the divided trays 75A and 75B. The sheaf of the recording sheets PT which has been folded passes through the nip region NP between the pair of folding rollers 78, and is transported along the guide 81.

As described above, when the tip portion 79C of the folding blade 79 is made to move toward the nip region NP between the pair of folding rollers 78, by the rotational movement of the rotary cam 80, the central portion of the sheaf of the recording sheets PT is squeezed into the nip region NP by the tip portion 79C, so that the sheaf of the recording sheets PT is folded by the pair of folding rollers 78.

Figure 7:
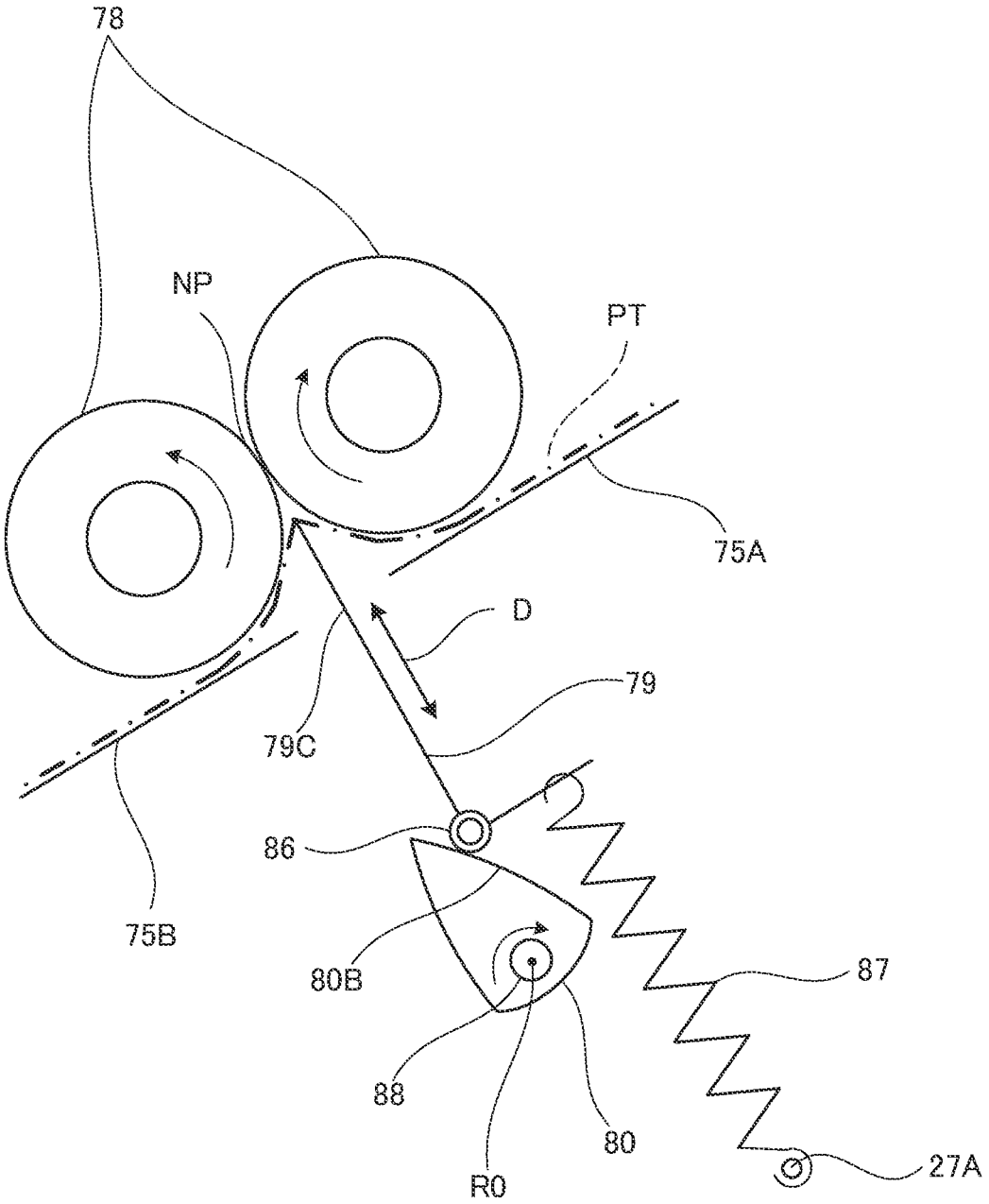
FIG. 7 is a cross-sectional view showing a sheaf of recording sheets in contact with the circumferential surface of a pair of folding rollers.

Now, the image forming device 12 forms the image of the source document on the recording sheet P, by the ink jet printing method using the ink. Accordingly, the sheaf of the recording sheets may be folded by the saddle-stitch binder 27 of the postprocessing device 20, before the ink applied to the recording sheet P dries out. In such a case, when the surface of the uppermost recording sheet P of the sheaf of the recording sheets PT is rubbed against the circumferential surface of the pair of folding rollers 78, as result of the sheaf of the recording sheets PT being brought into contact with the circumferential surface of the pair of folding rollers 78 as shown in FIG. 7, before the central portion of the sheaf of the recording sheets PT is squeezed into the nip region NP between the pair of folding rollers 78 by the tip portion 79C of the folding blade 79, in the saddle-stitch binder 27, the ink stuck to the surface of the recording sheet P migrates to the circumferential surface of the pair of folding rollers 78. Therefore, the circumferential surface of the pair of folding rollers 78 is stained by the ink, and such ink may migrate to the recording sheet P of another sheaf of the recording sheets PT, thereby also staining the recording sheet P of the other sheaf of the recording sheets PT.

The inventor of the disclosure has found out that the cause of the mentioned drawback lies in the difference between the moving speed of the tip portion 79C of the folding blade 79 and the moving speed of the circumferential surface of the pair of folding rollers 78. For example, in the case where the moving speed of the tip portion 79C of the folding blade 79 is slower than the moving speed of the circumferential surface of the pair of folding rollers 78, when the sheaf of the recording sheets PT is about to make contact with the circumferential surface of the pair of folding rollers 78, the moving speed of the sheaf of the recording sheets PT being lifted up by the tip portion 79C of the folding blade 79 is also slower than the moving speed of the circumferential surface of the pair of folding rollers 78. Therefore, the surface of the recording sheet P is rubbed against the circumferential surface of the pair of folding rollers 78, and the ink stuck to the surface of the recording sheet P migrates to the circumferential surface of the pair of folding rollers 78.

In the first embodiment, accordingly, the drive controller 56 matches the moving speed of the tip portion 79C of the folding blade 79 with the moving speed of the circumferential surface of the pair of folding rollers 78, when the sheaf of the recording sheets PT is about to make contact with the circumferential surface of the pair of folding rollers 78, before the central portion of the sheaf of the recording sheets PT is squeezed into the nip region NP between the pair of folding rollers 78, by the tip portion 79C of the folding blade 79. Such an arrangement allows the surface of the recording sheet P to enter into contact with the circumferential surface of the pair of folding rollers 78, while following up the movement thereof, thereby enabling the central portion of the sheaf of the recording sheets PT to be squeezed into the nip region NP between the pair of folding rollers 78, by the tip portion 79C of the folding blade 79, thus to fold the sheaf of the recording sheets PT, without causing the surface of the recording sheet P to be rubbed against the circumferential surface of the pair of folding rollers 78, or at least without incurring the mentioned drawback arising from the surface of the recording sheet P being rubbed against the pair of folding rollers 78.

The position and the moving speed of the tip portion 79C of the folding blade 79 may be determined according to the radius of the rotary cam 80 between the rotation center and the cam surface, the rate of change of the radius, and the rotation speed of the rotary cam 80.

For example, the position of the tip portion 79C of the folding blade 79 farthest from the nip region NP as shown in FIG. 5A (hereinafter, retracted position), the position of the tip portion 79C of the folding blade 79, when the sheaf of the recording sheets PT makes contact with the circumferential surface of the pair of folding rollers 78, as shown in FIG. 7 (hereinafter, contact position), and the position of the tip portion 79C of the folding blade 79, when the central portion of the sheaf of the recording sheets PT is squeezed into the nip region NP between the pair of folding rollers 78, as shown in FIG. 6A (hereinafter, squeezing position), are determined, through experiments. Then the radius of the rotary cam 80 between the rotation center and the cam surface, and the rate of change of the radius are determined, so as to allow the tip portion 79C of the folding blade 79 to move between the retracted position and the squeezing position via the contact position, and such that the moving speed of the tip portion 79C of the folding blade 79 increases until the tip portion 79C reaches the contact position from the retracted position, and that the moving speed of the tip portion 79C of the folding blade 79 is kept generally constant, until the tip portion 79C reaches the squeezing position from the contact position.

To match the moving speed of the tip portion 79C of the folding blade 79 with the moving speed of the circumferential surface of the pair of folding rollers 78, the rotation speed of the rotary cam 80 has to be increased in proportion to an increase in moving speed of the pair of folding rollers 78, and has to be reduced in proportion to a decrease in moving speed of the pair of folding rollers 78. The drive controller 56 determines the rotation speed of the pair of folding rollers 78, by controlling the rotation speed of the motor that drives the pair of folding rollers 78. The drive controller 56 determines the rotation speed of the rotary cam 80, by controlling the rotation speed of the motor 801 that drives the rotary cam 80.

The drive controller 56 controls the rotation speed of the rotary cam 80, according to the rotation speed of the motor of the pair of folding rollers 78, by controlling the operation of the respective motors that drive the pair of folding rollers 78 and the rotary cam 80, to thereby match the moving speed of the tip portion 79C of the folding blade 79 with the moving speed of the circumferential surface of the pair of folding rollers 78, when the sheaf of the recording sheets PT is about to make contact with the circumferential surface of the pair of folding rollers 78. For example, the drive controller 56 identifies in advance the position on the cam surface of the rotary cam 80 where the contact roller 86 makes contact, when the sheaf of the recording sheets PT makes contact with the circumferential surface of the pair of folding rollers 78 as shown in FIG. 7, and calculates the rotation speed of the rotary cam 80 that matches the moving speed of the tip portion 79C of the folding blade 79 with the moving speed of the circumferential surface of the pair of folding rollers 78, on the basis of the radius of the rotary cam 80 between the rotation center and the position on the cam surface identified as above, and the rate of change of such radius.

With the mentioned arrangement, the surface of the recording sheet P enters into contact with the circumferential surface of the pair of folding rollers 78, while following up the movement thereof, when the sheaf of the recording sheets PT makes contact with the circumferential surface of the pair of folding rollers 78 as shown in FIG. 7, and therefore the central portion of the sheaf of the recording sheets PT is squeezed into the nip region NP between the pair of folding rollers 78, by the tip portion 79C of the folding blade 79 as shown in FIG. 6A, thus to be folded, without the surface of the recording sheet P being rubbed against the circumferential surface of the pair of folding rollers 78.

Further, the drive controller 56 determines the radius of the rotary cam 80 between the rotation center and the cam surface, and the rate of change of the radius, so as to keep the moving speed of the tip portion 79C of the folding blade 79 generally constant, until the tip portion 79C reaches the squeezing position from the contact position. Therefore, the surface of the recording sheet P can be prevented from being rubbed against the circumferential surface of the pair of folding rollers 78, after the sheaf of the recording sheets PT reaches the circumferential surface of the pair of folding rollers 78, and until the sheaf of the recording sheets PT is squeezed into the nip region between the pair of folding rollers 78.

Second Embodiment

Figure 8:
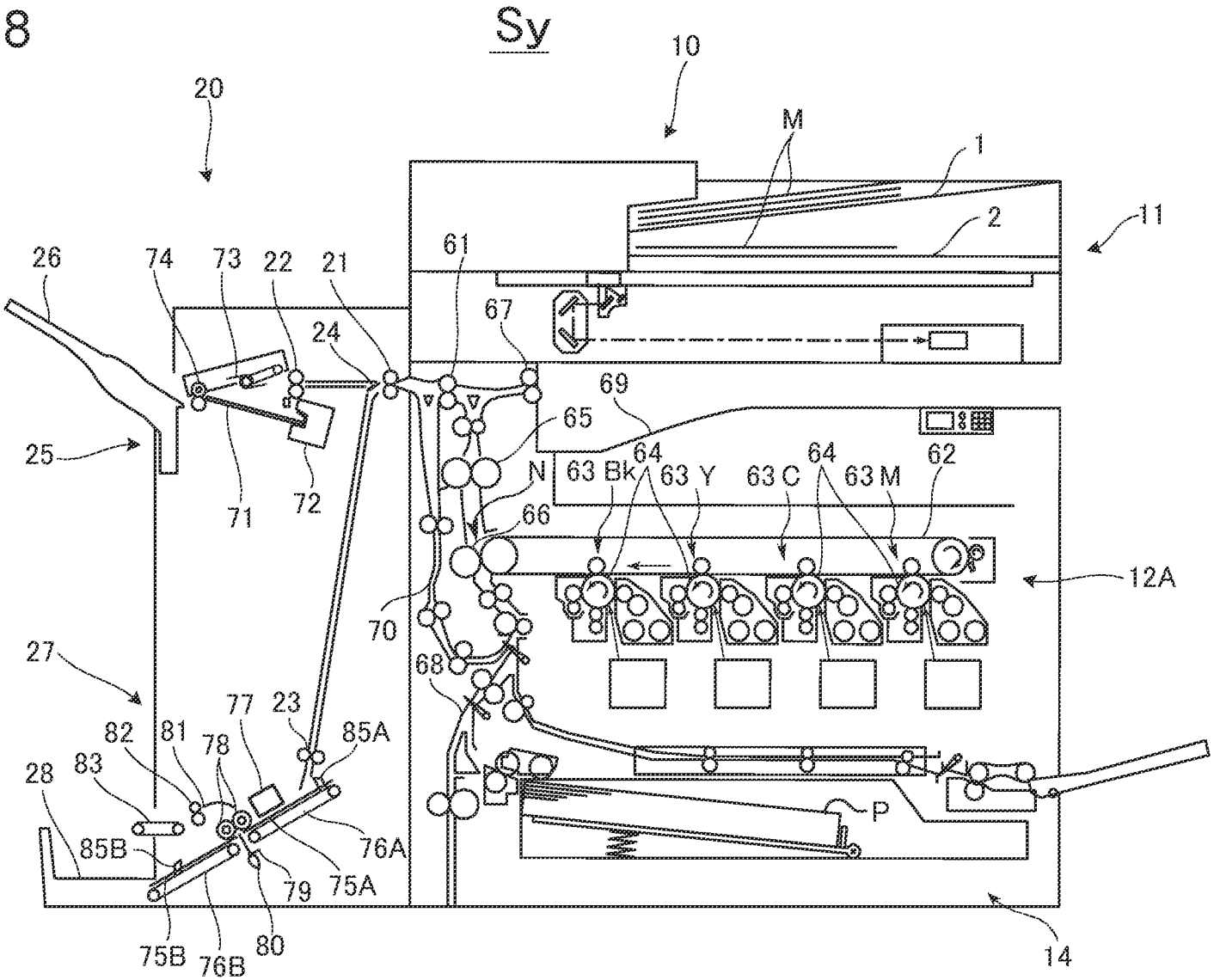
FIG. 8 is a cross-sectional view of an image forming apparatus and a postprocessing device, included in a postprocessing system according to a second embodiment.

FIG. 8 is a cross-sectional view of the image forming apparatus 10 and the postprocessing device 20, included in the postprocessing system Sy according to a second embodiment. In FIG. 8, the elements having the similar function as those shown in FIG. 1 are given the same numeral. In the following passage, the description of the same elements as those of the postprocessing system Sy according to the first embodiment will not be repeated.

As shown in FIG. 8, the postprocessing system Sy according to the second embodiment includes the image forming apparatus 10 that reads the image of a source document and forms the image on the recording sheet, and the postprocessing device 20 that receives the recording sheet from the image forming apparatus 10, and performs postprocessing on the recording sheet.

The image forming apparatus 10 includes the image reading device 11, and an image forming device 12A. image forming device 12A forms the image of the source document M represented by the image data, on the recording sheet P by electrophotography, using a developing agent containing toner, each time each of a plurality of pieces of image data, representing the respective images of a plurality of source documents M, is sequentially inputted. The image forming device 12A includes an image forming unit 63M for magenta, an image forming unit 63C for cyan, an image forming unit 63Y for yellow, and an image forming unit 63Bk for black.

The image forming units 63M, 63C, 63Y, and 63Bk each electrically charges the surface of a photoconductor drum 64 uniformly, expose the surface of the photoconductor drum 64 thereby forming an electrostatic latent image, develop the electrostatic latent image on the surface of the photoconductor drum 64 into a toner image, and transfer the toner image from the surface of the photoconductor drum 64 to an intermediate transfer belt 62. Through such process, a colored toner image is formed on the intermediate transfer belt 62. The colored toner image is secondarily transferred to the recording sheet P transported from the paper feeding device 14 along a first transport route 68, in a nip region N between the intermediate transfer belt 62 and a secondary transfer roller 66.

After causing the image forming device 12A to form the image of the source document M on the recording sheets P, the controller 46 of the image forming apparatus 10 causes a fixing device 65 to heat-press each recording sheet P to thereby fix the toner image on the recording sheet P by thermal compression. The controller 46 then transports the recording sheet P to the postprocessing device 20, through a transport roller 61.

When the image of the source document M is also to be formed on the back face of the recording sheet P, the controller 46 performs switchback transport, including transporting the recording sheet P to the delivery roller 67 on the near side of an output tray 69, and once stopping and then reversely rotating the delivery roller 67, to return the recording sheet P from the transport roller 61 to the nip region N of the first transport route 68 through a second transport route 70, in the inverted orientation. Then the controller 46 causes the image forming device 12A to form the image of the source document M on the back face of the recording sheet P, and transports the recording sheet P to the postprocessing device 20, through the transport roller 61.

The configuration of the mechanism of the postprocessing device 20 is the same as that of the first embodiment, described with reference to FIG. 1. The postprocessing device 20 sequentially receives the recording sheets P delivered from the image forming apparatus 10. For example, the saddle-stitch binder 27 performs the stapling operation on the central portion of the sheaf of the recording sheets, composed of a plurality of recording sheets P, folds the sheaf of the recording sheets at the center, and delivers the sheaf of the recording sheets to the output tray 28.

The configuration related to the control operation of the image forming apparatus 10 and the postprocessing device 20 according to the second embodiment is generally similar to that of the first embodiment shown in FIG. 2. However, the image forming apparatus 10 according to the second embodiment is different from that of the first embodiment, in including the image forming device 12A that performs the electrophotography, instead of the image forming device 12 that performs the ink jet printing. The controller 46 of the image forming apparatus 10 according to the second embodiment controls the image forming device 12A that performs the electrophotography, so as to cause the image forming device 12A to form the image of the source document M on the recording sheet P, through the process described above.

In the second embodiment, the controller 46 of the image forming apparatus 10 is connected to the image reading device 11, the image forming device 12A, the display device 41, the operation device 42, the touch panel 43, the storage device 44, and the I/F 47. The controller 46 controls the operation of the mentioned components, and transmits and receives signals and data, to and from these components.

In the second embodiment, the controller 46 of the image forming apparatus 10 and the drive controller 56 of the postprocessing device 20 are configured to transmit and receive data and signals between each other, via the respective I/Fs 47 and 57. For example, the controller 46 of the image forming apparatus 10 outputs a control signal for instructing the postprocessing device 20 to perform the postprocessing, to the drive controller 56 of the postprocessing device 20. The drive controller 56 of the postprocessing device 20 controls the operation of the one-side binder 25 or the saddle-stitch binder 27, according to the control signal received.

As mentioned above, the image forming device 12A forms the image on the recording sheet P by electrophotography, using a developing agent containing toner. Unlike the ink, the toner does not moisten the surface of the recording sheet P, and therefore the face of the recording sheet P on which the image has been formed remains dry. In addition, wax is mixed in the developing agent, and therefore the wax is also stuck to the surface of the recording sheet P, together with the toner. As result, the surface of the recording sheet P is smoothened, and friction is reduced.

Accordingly, even though the surface of the uppermost recording sheet P of the sheaf of the recording sheets PT is rubbed against the circumferential surface of the pair of folding rollers 78, as result of the sheaf of the recording sheets PT being brought into contact with the circumferential surface of the pair of folding rollers 78 as shown in FIG. 7, before the central portion of the sheaf of the recording sheets PT is squeezed into the nip region NP between the pair of folding rollers 78 by the tip portion 79C of the folding blade 79, in the saddle-stitch binder 27, the toner stuck to the surface of the recording sheet P does not migrate to the circumferential surface of the pair of folding rollers 78. Therefore, the circumferential surface of the pair of folding rollers 78 is not, or barely, stained by the toner.

However, since the friction among the recording sheets P of the sheaf of the recording sheets PT is low, the recording sheet P of the sheaf of the recording sheets PT may be deviated or torn, when the central portion of the sheaf of the recording sheets PT is folded in the nip region NP between the pair of folding rollers 78, in the case where the moving speed of the tip portion 79C of the folding blade 79 and the moving speed of the circumferential surface of the pair of folding rollers 78 are different from each other. For example, in the case where the moving speed of the tip portion 79C of the folding blade 79 is slower than the moving speed of the circumferential surface of the pair of folding rollers 78, when the central portion of the sheaf of the recording sheets PT is about to reach the circumferential surface of the pair of folding rollers 78, the moving speed of the sheaf of the recording sheets PT being lifted up by the tip portion 79C of the folding blade 79 is also slower than the moving speed of the circumferential surface of the pair of folding rollers 78. Therefore, only the uppermost recording sheet P of the sheaf of the recording sheets PT is caught by the nip region NP between the pair of folding rollers 78. As result, the uppermost recording sheet P is separated from the recording sheets P of the lower layer, and the central portion where the stapling operation has been performed may be deviated or torn, in some of the recording sheets P.

In the second embodiment, therefore, the drive controller 56 matches the moving speed of the tip portion 79C of the folding blade 79 with the moving speed of the circumferential surface of the pair of folding rollers 78, when the central portion of the sheaf of the recording sheets PT is squeezed into the nip region NP between the pair of folding rollers 78, by the tip portion 79C of the folding blade 79. Such an arrangement prevents the recording sheet P in the sheaf of the recording sheets PT from being deviated or torn, thereby allows the central portion of the sheaf of the recording sheets PT to be properly folded.

For example, the retracted position as shown in FIG. 5A and the squeezing position as shown in FIG. 6A are determined, and also an intermediate position between the retracted position and the squeezing position is determined as appropriate, through experiments. Then the radius of the rotary cam 80 between the rotation center and the cam surface, and the rate of change of the radius are determined, so as to allow the tip portion 79C of the folding blade 79 to move between the retracted position and the squeezing position via the intermediate position, and such that the moving speed of the tip portion 79C of the folding blade 79 increases until the tip portion 79C reaches the intermediate position from the retracted position, and that the moving speed of the tip portion 79C of the folding blade 79 is kept generally constant, until the tip portion 79C reaches the squeezing position from the intermediate position.

The drive controller 56 controls the rotation speed of the rotary cam 80, according to the rotation speed of the motor of the pair of folding rollers 78, by controlling the operation of the respective motors that drive the pair of folding rollers 78 and the rotary cam 80, to thereby match the moving speed of the tip portion 79C of the folding blade 79 with the moving speed of the circumferential surface of the pair of folding rollers 78, when the central portion of the sheaf of the recording sheets PT is squeezed into the nip region NP between the pair of folding rollers 78, by the tip portion 79C of the folding blade 79. For example, the drive controller 56 identifies in advance the position on the cam surface of the rotary cam 80 where the contact roller 86 makes contact, when the central portion of the sheaf of the recording sheets PT is squeezed into the nip region NP between the pair of folding rollers 78, by the tip portion 79C of the folding blade 79, and calculates the rotation speed of the rotary cam 80 that matches the moving speed of the tip portion 79C of the folding blade 79 with the moving speed of the circumferential surface of the pair of folding rollers 78, on the basis of the radius of the rotary cam 80 between the rotation center and the position on the cam surface identified as above, and the rate of change of such radius.

With the mentioned arrangement, when the central portion of the sheaf of the recording sheets PT is squeezed into the nip region NP between the pair of folding rollers 78, by the tip portion 79C of the folding blade 79 as shown in FIG. 6A, thus to be folded, the moving speed of the tip portion 79C of the folding blade 79 matches with the moving speed of the circumferential surface of the pair of folding rollers 78. Therefore, such a trouble that only the uppermost recording sheet P of the sheaf of the recording sheets PT is caught by the nip region NP between the pair of folding rollers 78, and separated from the recording sheets P of the lower layer, can be avoided, and the central portion of some of the recording sheets P, where the stapling operation has been performed, can be prevented from being deviated or torn.

Further, the drive controller 56 determines the radius of the rotary cam 80 between the rotation center and the cam surface, and the rate of change of the radius, so as to keep the moving speed of the tip portion 79C of the folding blade 79 generally constant, until the tip portion 79C reaches the squeezing position from the intermediate position. Therefore, the central portion of the recording sheets P in the sheaf of the recording sheets PT can be more effectively prevented from being deviated or torn.

Third Embodiment

A third embodiment is based on the assumption that the postprocessing device 20 is compatible with both of the image forming apparatus 10 that performs the ink jet printing, and the image forming apparatus 10 that performs the electrophotography. The drive controller 56 of the postprocessing device 20 changes the rotation speed of the rotary cam 80 in the saddle-stitch binder 27 of the postprocessing device, depending on whether the image forming apparatus 10 is configured to perform the ink jet printing or electrophotography.

The rotary cam 80 is, for example, configured similarly to that of the first embodiment. Accordingly, the radius of the rotary cam 80 between the rotation center and the cam surface, and the rate of change of the radius are determined, so as to allow the tip portion 79C of the folding blade 79 to move between the retracted position and the squeezing position via the contact position, and such that the moving speed of the tip portion 79C of the folding blade 79 increases until the tip portion 79C reaches the contact position from the retracted position, and that the moving speed of the tip portion 79C of the folding blade 79 is kept generally constant, until the tip portion 79C reaches the squeezing position from the contact position.

The user instructs the execution of the saddle-stitch binding operation, by operating the GUI displayed on the screen of the display device 41, through the touch panel 43, sets a plurality of source documents M on the image reading device 11, and presses the start key on the operation device 42.

The controller 46 of the image forming apparatus 10 outputs the instruction to execute the saddle-stitch binding operation, and a control signal indicating whether the image forming apparatus 10 is configured to perform the ink jet printing or the electrophotography, to the postprocessing device 20 via the I/F 47. At the same time, the controller 46 causes the image reading device 11 to sequentially read the images of the source documents M, causes the image forming device 12 to form the images of the source documents M on the respective recording sheets P, and sequentially transports the recording sheets P to the postprocessing device 20.

The drive controller 56 of the postprocessing device 20 receives the control signal via the I/F 57, and sequentially receives the recording sheets P delivered from the image forming apparatus 10. The drive controller 56 decides whether the image forming apparatus 10 is configured to perform the ink jet printing or the electrophotography, according to the control signal, controls the operation of the saddle-stitch binder 27 so as to perform the stapling operation on the central portion of the sheaf of the recording sheets composed of a plurality of recording sheets P, folds the sheaf of the recording sheets at the center, and delivers the sheaf of the recording sheets to the output tray 28.

To be more specific, in the case of deciding that the image forming apparatus 10 is configured to perform the ink jet printing, the drive controller 56 of the postprocessing device 20 controls the rotation speed of the rotary cam 80, according to the rotation speed of the motor of the pair of folding rollers 78, by controlling the operation of the respective motors that drive the pair of folding rollers 78 and the rotary cam 80, to thereby match the moving speed of the tip portion 79C of the folding blade 79 with the moving speed of the circumferential surface of the pair of folding rollers 78, when the sheaf of the recording sheets is about to make contact with the circumferential surface of the pair of folding rollers 78.

With the mentioned arrangement, the surface of the recording sheet P enters into contact with the circumferential surface of the pair of folding rollers 78, while following up the movement thereof, when the sheaf of the recording sheets makes contact with the circumferential surface of the pair of folding rollers 78, and therefore the central portion of the sheaf of the recording sheets is squeezed into the nip region NP between the pair of folding rollers 78, by the tip portion 79C of the folding blade 79, thus to be folded, without the surface of the recording sheet P being rubbed against the circumferential surface of the pair of folding rollers 78.

Further, the radius of the rotary cam 80 between the rotation center and the cam surface, and the rate of change of the radius, are determined so as to keep the moving speed of the tip portion 79C of the folding blade 79 generally constant, until the tip portion 79C reaches the squeezing position from the contact position. Therefore, the moving speed of the tip portion 79C of the folding blade 79 does not largely differ from the moving speed of the circumferential surface of the pair of folding rollers 78, when the central portion of the sheaf of the recording sheets is squeezed into the nip region NP. In the case of the recording sheets P wet with the ink, the recording sheets P stacked on each other are barely deviated from each other. Therefore, the recording sheets P in the sheaf of the recording sheets can be prevented from being deviated or torn.

In contrast, in the case of deciding that the image forming apparatus 10 is configured to perform the electrophotography, the drive controller 56 of the postprocessing device 20 controls the rotation speed of the rotary cam 80, according to the rotation speed of the motor of the pair of folding rollers 78, by controlling the operation of the respective motors that drive the pair of folding rollers 78 and the rotary cam 80, to thereby match the moving speed of the tip portion 79C of the folding blade 79 with the moving speed of the circumferential surface of the pair of folding rollers 78, when the central portion of the sheaf of the recording sheets is squeezed into the nip region NP between the pair of folding rollers 78, by the tip portion 79C of the folding blade 79.

With the mentioned arrangement, when the central portion of the sheaf of the recording sheets is squeezed into the nip region NP between the pair of folding rollers 78, by the tip portion 79C of the folding blade 79 as shown in FIG. 6A, thus to be folded, such a trouble that only the uppermost recording sheet of the sheaf of the recording sheets is caught by the nip region NP between the pair of folding rollers 78, and separated from the recording sheets of the lower layer, can be avoided. As result, the central portion of some of the recording sheet P, where the stapling operation has been performed, can be prevented from being deviated or torn.

Further, the radius of the rotary cam 80 between the rotation center and the cam surface, and the rate of change of the radius, are determined so as to keep the moving speed of the tip portion 79C of the folding blade 79 generally constant, until the tip portion 79C reaches the squeezing position from the contact position. Therefore, the moving speed of the tip portion 79C of the folding blade 79 does not largely differ from the moving speed of the circumferential surface of the pair of folding rollers 78, when the sheaf of the recording sheets reaches the circumferential surface of the pair of folding rollers 78. In addition, since the surface of the recording sheet P to which the toner is stuck is dry, the wax is stuck to the surface of the recording sheet P together with the toner, and the surface of the recording sheet P is smoothened. As result, the friction among the surfaces of the recording sheets P becomes low, and the toner stuck to the surface of the recording sheet P is kept from migrating to the circumferential surface of the pair of folding rollers 78, and the circumferential surface of the pair of folding rollers 78 can be exempted from being stained by the toner, even though the surface of the recording sheet is slightly rubbed against the circumferential surface of the pair of folding rollers 78, when the sheaf of the recording sheets makes contact with the circumferential surface of the pair of folding rollers 78.

Now, when the folding blade starts to move from the position distant from the nip region between the pair of folding rollers, and moves toward the nip region, the moving speed of the tip portion of the folding blade varies, during such movement. Accordingly, the moving speed of the tip portion of the folding blade has to be properly controlled.

The inventor of the disclosure has found out that the relation between the moving speed of the tip portion of the folding blade and the moving speed of the circumferential surface of the pair of folding rollers, for folding the sheaf of the sheets without trouble, is different between the sheaf of the sheets on which the image has been formed by ink jet printing and the sheaf of the sheets on which the image has been formed by electrophotography. For example, in the case of the ink jet printing, the ink on the recording sheet migrates to the circumferential surface of the pair of folding rollers, when the moving speed of the tip portion of the folding blade differs from the moving speed of the circumferential surface of the pair of folding rollers, at the time point that the recording sheet is about to make contact with the circumferential surface of the pair of folding rollers. Therefore, it is preferable to match the moving speed between the tip portion of the folding blade and the circumferential surface of the pair of folding rollers, at the mentioned time point. In the case of the electrophotography, in contrast, it is not mandatory to match the moving speed.

In the aforementioned known folding device, the moving speed of the folding blade is set slower than the moving speed of the pair of folding rollers. However, no reference is made regarding the mentioned point that the relation between the moving speed of the tip portion of the folding blade and the moving speed of the circumferential surface of the pair of folding rollers, for folding the sheaf of the sheets free from a trouble, is different between the case of the ink jet printing and the case of the electrophotography.

In addition, in the foregoing known sheet postprocessing device, the moving speed of the squeezing plate is set faster than the transport speed of the recording sheets. However, the mentioned point is not referred to, either.

With the first to third embodiments described above, in contrast, the relation between the moving speed of the tip portion of the folding blade and the moving speed of the circumferential surface of the pair of folding rollers is properly defined, and therefore the sheaf of the sheets can be folded, without trouble.

Although the drive controller 56 is provided in the postprocessing device 20 in the foregoing embodiments, the drive controller 56 may be excluded, and the controller 46 may directly control the postprocessing device 20.

In addition, a cam of a different type from the rotary cam 80 may be employed. Among the wide variety of known cams, for example, a cam that converts a horizontal motion to a vertical motion may be employed, instead of the rotary cam 80.

Further, the configurations and processings described in the foregoing embodiment and variations with reference to FIG. 1 to FIG. 8 are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. A postprocessing device comprising:

a pair of folding rollers that form a nip region by being pressed against each other, and pinch and fold a sheaf of the sheets, by rotating in opposite directions to each other;

a folding blade supported so as to move toward and away from the nip region at predetermined moving speed, and configured to squeeze the sheaf of the sheets into the nip region;

a transport device that transports the sheets to a position between the nip region and the folding blade;

a drive portion that moves the folding blade toward and away from the nip region; and a drive controller configured to control an operation of the drive portion, the drive controller being configured to control the operation of the drive portion to match the moving speed of a tip portion of the folding blade with moving speed of a circumferential surface of the pair of folding rollers, at a time point that the sheaf of the sheets makes contact with the circumferential surface of the pair of folding rollers, wherein the drive portion includes:

a contact roller located at an end portion of the folding blade;

a rotary cam formed in such a shape that a radius between a rotation center and a cam surface is different, depending on a position on the cam surface, and configured to move the folding blade toward and away from the nip region, by rotating to move the contact roller along the cam surface; and a motor that drives the rotary cam so as to rotate, and the drive controller is configured to:

identify in advance a position on the cam surface of the rotary cam to be contacted by the contact roller, at a time point that the sheaf of the sheets makes contact with the circumferential surface of the pair of folding rollers;

calculate rotation speed of the rotary cam that matches the moving speed of the tip portion of the folding blade with the moving speed of the circumferential surface of the pair of folding rollers, at the time point that the sheaf of the sheets makes contact with the circumferential surface of the pair of folding rollers, on a basis of the radius of the rotary cam between the rotation center and the identified position on the cam surface and a rate of change of the radius; and control operation of the drive portion, on a basis of the rotation speed calculated.

2. The postprocessing device according to claim 1, wherein the radius of the rotary cam between the rotation center and the cam surface, and the rate of change of the radius, are determined such that the moving speed of the tip portion of the folding blade increases until the tip portion reaches a predetermined first position, and that the moving speed of the tip portion is kept constant, until the tip portion reaches a predetermined second position from the first position.

3. A postprocessing device comprising:

a pair of folding rollers that form a nip region by being pressed against each other, and pinch and fold a sheaf of the sheets, by rotating in opposite directions to each other;

a folding blade supported so as to move toward and away from the nip region at predetermined moving speed, and configured to squeeze the sheaf of the sheets into the nip region;

a transport device that transports the sheets to a position between the nip region and the folding blade;

a drive portion that moves the folding blade toward and away from the nip region; and a drive controller configured to control an operation of the drive portion, the drive controller being configured to control the operation of the drive portion to match the moving speed of a tip portion of the folding blade with moving speed of a circumferential surface of the pair of folding rollers, at a time point that the sheaf of the sheets reaches the nip region, wherein the drive portion includes:

a contact roller located at an end portion of the folding blade;

a rotary cam formed in such a shape that a radius between a rotation center and a cam surface is different, depending on a position on the cam surface, and configured to move the folding blade toward and away from the nip region, by rotating to move the contact roller along the cam surface; and a motor that drives the rotary cam so as to rotate, and the drive controller is configured to:

identify in advance a position on the cam surface of the rotary cam to be contacted by the contact roller, at a time point that the sheaf of the sheets reaches the nip region;

calculate rotation speed of the rotary cam that matches the moving speed of the tip portion of the folding blade with the moving speed of the circumferential surface of the pair of folding rollers, at the time point that the sheaf of the sheets reaches the nip region, on a basis of the radius of the rotary cam between the rotation center and the identified position on the cam surface and a rate of change of the radius; and control operation of the drive portion, on a basis of the rotation speed calculated.

* * * * *